US008057287B2

(12) United States Patent
Chao et al.

(10) Patent No.: US 8,057,287 B2
(45) Date of Patent: Nov. 15, 2011

(54) ABRASIVE MESH FOR A POWERED GRINDING WHEEL

(75) Inventors: Ching-Chi Chao, Taichung (TW); Yi-Shen Lai, Taichung (TW)

(73) Assignee: HG Tools Co., Ltd., Taichung (TW)

( * ) Notice: Subject to any disclaimer, the term of this patent is extended or adjusted under 35 U.S.C. 154(b) by 333 days.

(21) Appl. No.: 12/538,526

(22) Filed: Aug. 10, 2009

(65) Prior Publication Data

US 2011/0034115 A1 Feb. 10, 2011

(51) Int. Cl.
*B24B 29/00* (2006.01)

(52) U.S. Cl. ..... 451/544; 451/548

(58) Field of Classification Search ..... 451/544, 451/548

See application file for complete search history.

(56) References Cited

U.S. PATENT DOCUMENTS

| | | | | | |
|---|---|---|---|---|---|
| 2,814,918 | A * | 12/1957 | Erickson | 451/546 |
| RE24,548 | E * | 10/1958 | Erickson | 451/546 |
| 2,984,052 | A * | 5/1961 | Mueller, Jr. | 451/536 |
| 5,131,924 | A * | 7/1992 | Wiand | 51/293 |
| 5,843,542 | A * | 12/1998 | Brushafer et al. | 428/36.1 |
| 6,786,812 | B2 * | 9/2004 | Stuckenholz et al. | 451/490 |
| 7,438,635 | B2 * | 10/2008 | Hoglund | 451/527 |
| 7,517,277 | B2 * | 4/2009 | Muldowney | 451/527 |
| 2003/0013397 | A1 * | 1/2003 | Rhoades | 451/527 |
| 2005/0124274 | A1 * | 6/2005 | Hoglund | 451/532 |

* cited by examiner

*Primary Examiner* — Maurina Rachuba

(57) ABSTRACT

An abrasive mesh for a powered grinding wheel is made by weaving plural twisted warp threads with plural single weft threads. The twisted warp threads construct an even machining surface for grinding the workpiece evenly, avoiding the occurrence of surface scratch. Since the twisted warp threads are connected to the single weft threads by weaving, the structure strength of the abrasive mesh is relatively high, thus extending its service life. Further, the abrasive mesh can be applied to grind the workpiece requiring high grinding fineness.

4 Claims, 5 Drawing Sheets

ABRASIVE MESH FOR A POWERED GRINDING WHEEL

BACKGROUND OF THE INVENTION

1. Field of the Invention

The present invention relates to a grinding wheel, and more particularly to an abrasive mesh for a powered grinding wheel.

2. Description of the Prior Art

Grinding wheel may find its use in many different applications, and it performs grinding by use of an abrasive mesh. Referring to FIG. 1, an abrasive mesh 10 commonly comprises a mesh cloth 11 coated with emery 12 which is prone to dropping off as the grinding operation is performed. The problem is that the mesh cloth 11 will become loose after losing the emery 12 since the mesh cloth 11 of the abrasive mesh 10 is made by plain weaving, namely, by interlacing a plurality of weft and warp threads 111, 112, so that after the emery 12 on an outer surface of the mesh cloth 11 drops off, the structure of the mesh cloth will become loose due to lack of the adhesion of the emery 12, and consequently the mesh cloth 11 is prone to breaking, greatly shortening its service life.

Hence, further referring to FIGS. 2 and 3, another conventional abrasive mesh 20 has a mesh cloth 21 made by weaving plural twisted warp threads 211 with plural single weft threads 212 in a staggered manner. The twisted warp threads 211 are formed by twisting of a thread. When the twisted warp threads 211 are staggered with the single weft threads 212, the single weft threads 212 will be inserted through the twisted warp threads 211 to connect the twisted warp threads 211 so as to form a durable structure for the mesh cloth 21. However, after the mesh cloth 21 is coated with emery 22, since the single weft threads 212 are inserted through the twisted warp threads 211 to cause bulges on the twisted warp threads 211, which will cause the surface of the abrasive mesh 20 to be rough and uneven. When grinding, the rough abrasive mesh 20 is prone to scratching the workpiece, so that the abrasive mesh 20 cannot be applied to grind the workpiece requiring high surface grinding fineness.

The present invention has arisen to mitigate and/or obviate the afore-described disadvantages.

SUMMARY OF THE INVENTION

The primary objective of the present invention is to provide an abrasive mesh for a powered grinding wheel, which has a durable structure and can avoid the occurrence of surface scratch on the workpiece.

In order to achieve the above objective, an abrasive mesh for a powered grinding wheel in accordance with the present invention is to be attached to a grinding machine to grind a workpiece and comprises a machining surface, a connecting bottom surface, and an emery coating layer. The machining surface is made up of twisted warp threads that are located on the same plane and includes a grinding portion and a connecting portion, and the machining surface utilizes the grinding portion to grind the workpiece. The connecting bottom surface is made up of plural single weft threads that are connected to the connecting portion of the machining surface, and the single weft threads are connected to the twisted warp threads of the machining surface to form plural connecting points and construct plural holes. The emery coating layer is attached to both the machining surface and the connecting bottom surface. By utilizing the even machining surface made up of twisted warp threads to grind the workpiece, the workpiece will be grinded evenly, avoiding scratching the workpiece. Further, the abrasive mesh of the present invention can be applied to grind the workpieces requiring high surface grinding fineness.

DETAILED DESCRIPTION OF THE PREFERRED EMBODIMENTS

Figure 1:
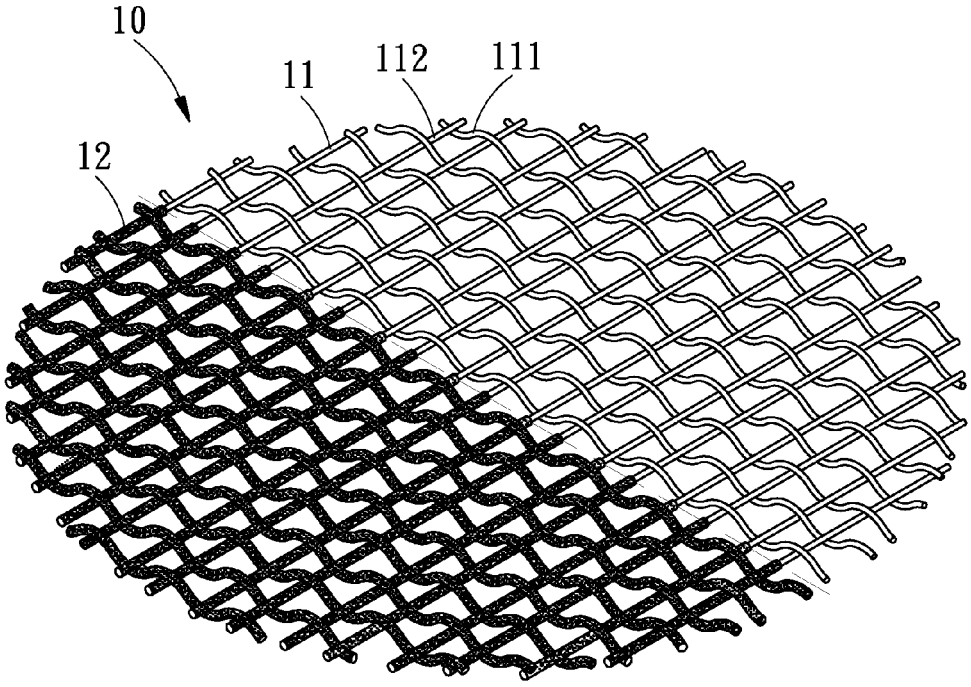
FIG. 1 PRIOR ART
FIG. 1 is a schematic view of a conventional abrasive mesh which is made by plain weaving.
Figure 2:
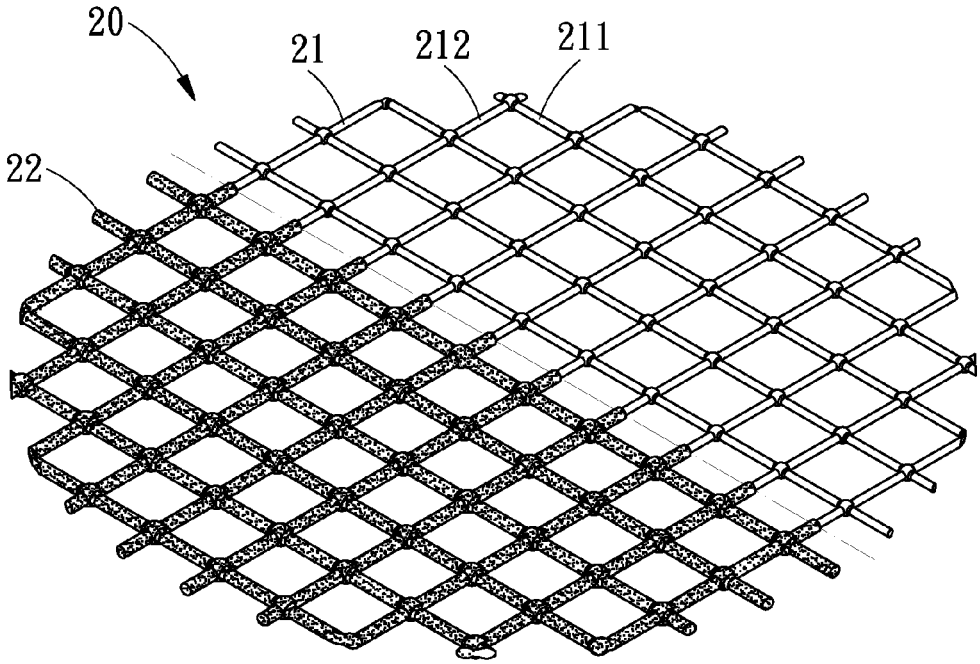
FIG. 2 PRIOR ART
FIG. 2 is a schematic view of another conventional abrasive mesh.
Figure 3:
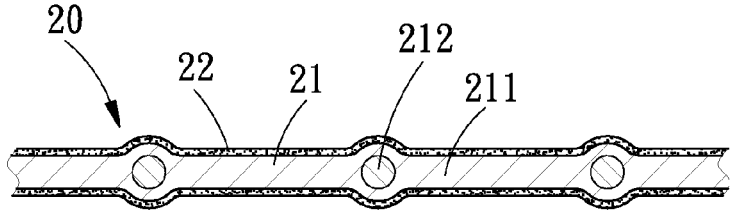
FIG. 3 PRIOR ART
FIG. 3 is a cross-sectional view of FIG. 2.
Figure 4:
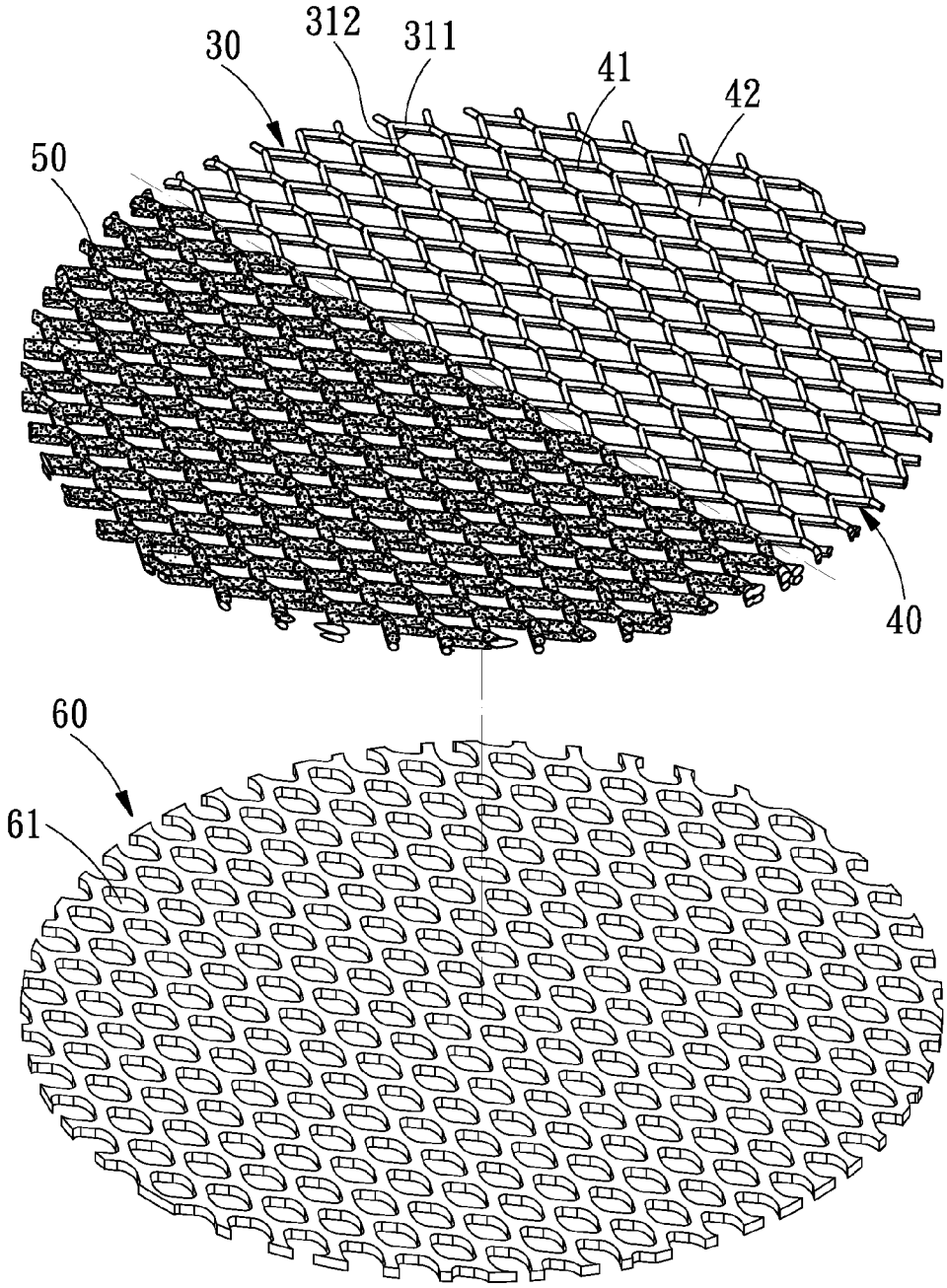
FIG. 4 is an exploded view of an abrasive mesh for a powered grinding wheel in accordance with the present invention.
Figure 5:
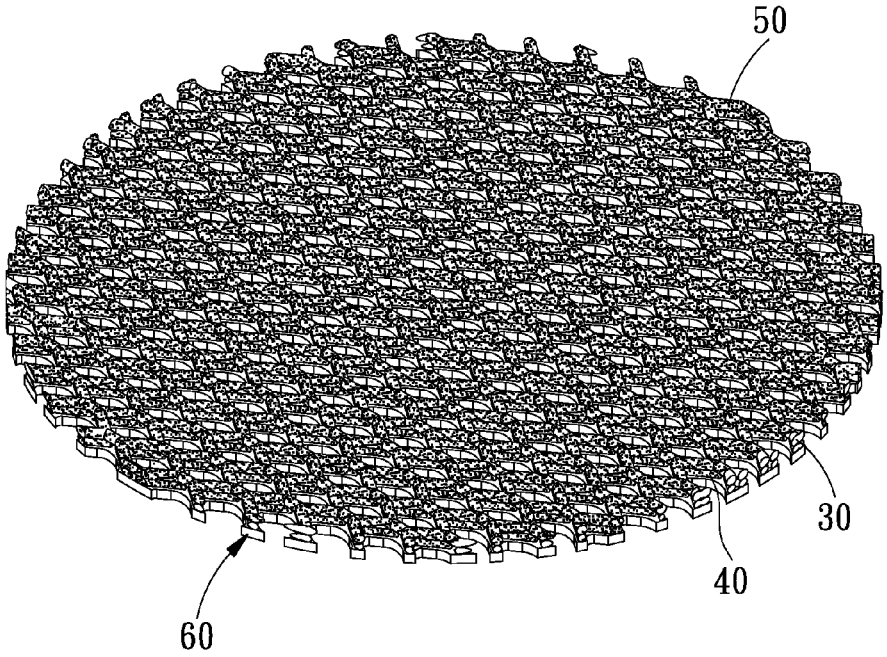
FIG. 5 is an assembly view of the abrasive mesh for a powered grinding wheel in accordance with the present invention.
Figure 6:
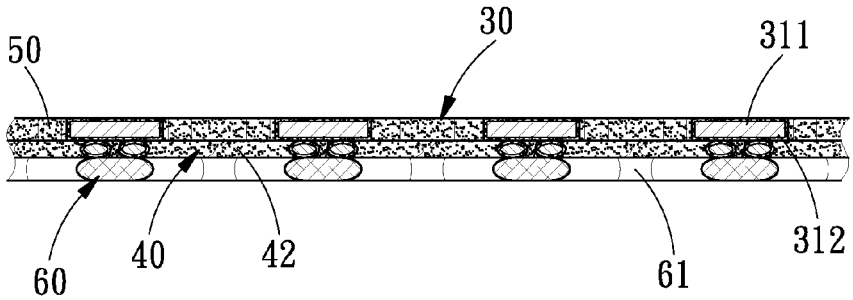
FIG. 6 is a cross-sectional view of the abrasive mesh for a powered grinding wheel in accordance with the present invention.

The present invention will be clearer from the following description when viewed together with the accompanying drawings, which show, for purpose of illustrations only, the preferred embodiment in accordance with the present invention.

Referring to FIGS. 4-8, an abrasive mesh for a powered grinding wheel in accordance with the present invention is to be attached to a grinding machine A which is provided with a hook and loop tape B at one side thereof.

The abrasive mesh in accordance with the present invention comprises a machining surface 30, a connecting bottom surface 40 and an emery coating layer 50.

The machining surface 30 is made up of plural twisted warp threads 31 that are located on the same plane and includes a grinding portion 311 and a connecting portion 312.

The connecting bottom surface 40 is made up of plural single weft threads 41 that are connected to the connecting portion 312 of the machining surface 30. The single weft threads 41 are connected to the twisted warp threads 31 of the machining surface 30 to form plural connecting points and construct plural hexangular holes 42.

The emery coating layer 50 is attached to both the machining surface 30 and the connecting bottom surface 40.

Figure 7:
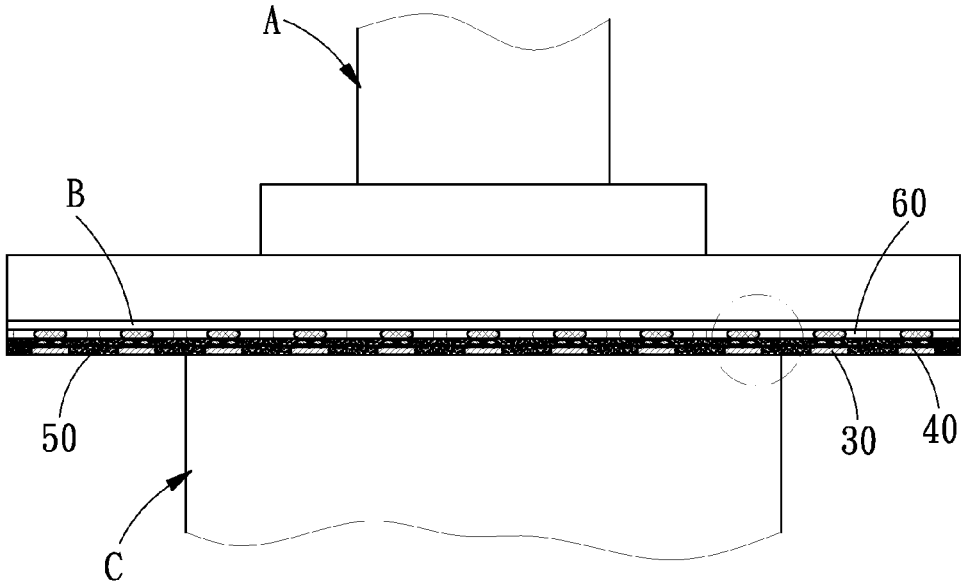
FIG. 7 is an operational view of the abrasive mesh for a powered grinding wheel in accordance with the present invention.
Figure 8:
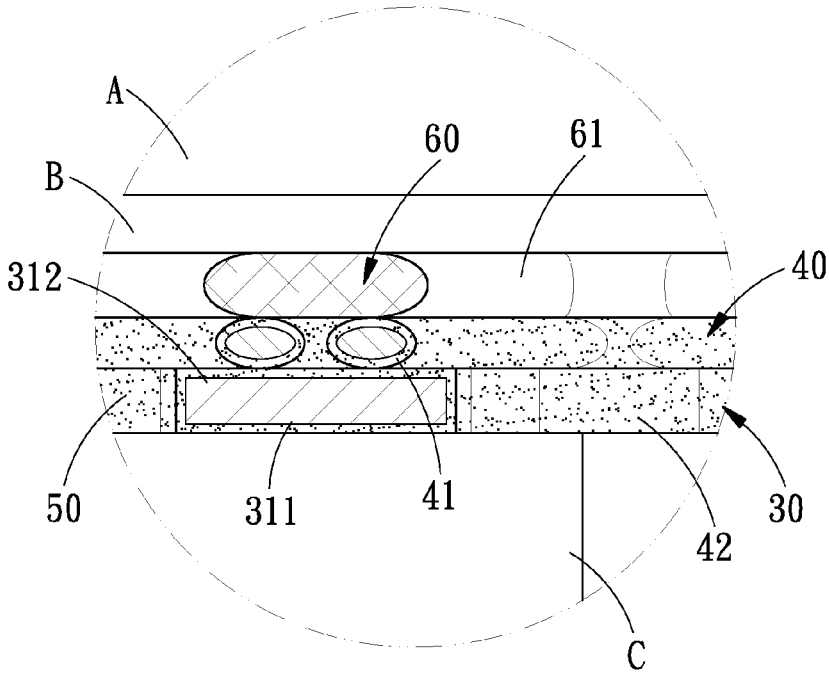
FIG. 8 is a partial enlarged view of FIG. 7 in accordance with the present invention.

As shown in FIGS. 7 and 8, the abrasive mesh of the present invention is to be attached to the hook and loop tape B of the grinding machine A, so the abrasive mesh will be used together with a cotton mesh fabric 60. The cotton mesh fabric 60 includes plural holes 61 in alignment with the respective holes 42 of the abrasive mesh. The cotton mesh fabric 60 is attached to the connecting bottom surface 40, and the abrasive mesh is attached to the hook and loop tape B of the grinding machine A by the cotton mesh fabric 60. During a grinding operation, the grinding portion 311 of the machining surface 30 is used to grind the workpiece. Since the machining surface 30 is made up of the twisted warp threads 31, the machining surface 30 is an even surface. As a result, the workpiece can be grinded evenly, avoiding the occurrence of surface scratch. Consequently, the abrasive mesh of the present invention can be applied to grind the workpieces requiring the high surface grinding fineness.

The holes 42 constructed by the twisted warp threads 31 and the single weft threads 41 and the holes 61 of the cotton mesh fabric 60 are provided for discharging scraps during grinding. The scraps generated by grinding can be smoothly discharged through the holes 42, 61, improving the grinding efficiency.

While we have shown and described various embodiments in accordance with the present invention, it is clear to those skilled in the art that further embodiments may be made without departing from the scope of the present invention.

What is claimed is:

1. An abrasive mesh for a powered grinding wheel being to be attached to a grinding machine for grinding a workpiece, and comprising:

a machining surface being made up of twisted warp threads that are located on the same plane and including a grinding portion and a connecting portion, the machining surface utilizing the grinding portion to grind the workpiece;

a connecting bottom surface being made up of plural single weft threads that are connected to the connecting portion of the machining surface, the single weft threads being connected to the twisted warp threads of the machining surface to form plural connecting points and construct plural holes; and an emery coating layer being attached to both the machining surface and the connecting bottom surface.

2. The abrasive mesh for a powered grinding wheel as claimed in claim 1 further comprising a cotton mesh fabric, the cotton mesh fabric including plural holes in alignment with the respective holes of the abrasive mesh and being attached to the connecting bottom surface.

3. The abrasive mesh for a powered grinding wheel as claimed in claim 2, wherein the grinding machine is provided with a hook and loop tape at one side thereof, and the abrasive mesh is attached to the hook and loop tape of the grinding machine by the cotton mesh fabric.

4. The abrasive mesh for a powered grinding wheel as claimed in claim 2, wherein the holes of the abrasive mesh are hexangular.

* * * * *